US009562450B1

(12) United States Patent
Woods et al.

(10) Patent No.: US 9,562,450 B1
(45) **Date of Patent: *Feb. 7, 2017**

(54) MARINE MUFFLER WITH PULSE ATTENUATION TUNING

(71) Applicants: Woodrow Woods, Riviera Beach, FL (US); Darrin Woods, Riviera Beach, FL (US)

(72) Inventors: Woodrow Woods, Riviera Beach, FL (US); Darrin Woods, Riviera Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/057,519

(22) Filed: Mar. 1, 2016

Related U.S. Application Data

(63) Continuation of application No. 14/504,896, filed on Oct. 2, 2014, now Pat. No. 9,273,588.

(60) Provisional application No. 61/885,538, filed on Oct. 2, 2013.

(51) Int. Cl.

| | |
|---|---|
| ***F01N 13/00*** | (2010.01) |
| ***F01N 1/08*** | (2006.01) |
| ***F01N 13/08*** | (2010.01) |
| *B63H 21/32* | (2006.01) |

(52) U.S. Cl.
CPC ..... *F01N 1/083* (2013.01); *F01N 13/004* (2013.01); *F01N 13/08* (2013.01); *B63H 21/32* (2013.01)

(58) Field of Classification Search
CPC ..... F01N 13/004
USPC ..... 181/235, 260, 268, 270, 272, 275
See application file for complete search history.

(56) References Cited

U.S. PATENT DOCUMENTS

| | | | | |
|---|---|---|---|---|
| 4,371,053 | A * | 2/1983 | Jones | F01N 1/02 181/249 |
| 4,918,917 | A | 4/1990 | Woods | |
| 5,196,655 | A | 3/1993 | Woods | |
| 5,228,876 | A | 7/1993 | Woods | |
| 5,262,600 | A | 11/1993 | Woods | |
| 5,444,196 | A | 8/1995 | Woods | |
| 5,504,280 | A | 4/1996 | Woods | |
| 5,616,893 | A | 4/1997 | Woods | |
| 5,625,173 | A | 4/1997 | Woods | |
| 5,718,462 | A | 2/1998 | Woods | |
| 5,740,670 | A | 4/1998 | Woods | |
| 6,564,901 | B2 | 5/2003 | Woods | |

(Continued)

*Primary Examiner* — Jeremy Luks
(74) *Attorney, Agent, or Firm* — Mark D. Bowen; Malin Haley DiMaggio & Bowen, P.A.

(57) ABSTRACT

A marine muffler adapted with an internally tunable sound suppression structure is adaptable to different configurations thereby allowing for structural adjustments to optimize sound suppression and minimize backpressure for particular engine and exhaust conditions. A muffler housing defines an interior volume and includes an exhaust inlet and outlet. The outlet has a reduced diameter as compared with the inlet such that the exhaust gas accelerates through the muffler. An inclined baffle partitions the interior volume into a lower chamber in communication with the exhaust inlet and an upper chamber in communication with the exhaust outlet. Exhaust ducts attached to each side wall penetrate the baffle thereby placing the upper and lower chambers in fluid communication. A corrugated partition divides each exhaust duct into a plurality of non-circular conduits. The muffler may be tuned by selectively capping one or more conduit outlets.

9 Claims, 5 Drawing Sheets

(56) References Cited

U.S. PATENT DOCUMENTS

| | | | | |
|---|---|---|---|---|
| 6,651,773 | B1 * | 11/2003 | Marocco | F01N 1/02 181/212 |
| 7,581,620 | B2 | 9/2009 | Woods | |
| 7,905,322 | B2 | 3/2011 | Woods | |
| 7,942,238 | B2 | 5/2011 | Woods | |
| 8,181,671 | B2 * | 5/2012 | Butler | F16L 55/02709 138/37 |
| 8,246,403 | B2 | 8/2012 | Woods | |
| 8,651,907 | B2 | 2/2014 | Woods | |
| 9,273,588 | B1 * | 3/2016 | Woods | F01N 13/004 |

* cited by examiner

MARINE MUFFLER WITH PULSE ATTENUATION TUNING

CROSS REFERENCE TO RELATED APPLICATIONS

This application is a continuation of U.S. patent application Ser. No. 14/504,896, now U.S. Pat. No. 9,273,588, which claims the benefit of provisional U.S. Patent Application Ser. No. 61/885,538, filed on Oct. 2, 2013.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to marine exhaust systems for use with internal combustion marine engines, and more particularly to an improved marine muffler having an inclined baffle assembly and tunable pulse attenuation exhaust conduits that provide improved exhaust noise silencing.

2. Description of Related Art

Marine vessels are typically configured with a propulsion system powered by an internal combustion engine mounted within the vessel hull. Exhaust generated by the engine is commonly combined with cooling water and routed through exhaust conduit to the stern of the vessel via one or more exhaust ducts where the exhaust is discharged through one or more exhaust ports formed in the transom. One or more mufflers are installed within the exhaust duct(s) to silence noise associated with the engine and exhaust gases.

A variety of structures are known in the background art for use in silencing marine exhaust noise. The present inventor has invented a number of novel marine exhaust components that have greatly improved the silencing and efficiency of marine exhaust systems. Among those inventions developed by a named inventor for the present invention are the following:

| U.S. Pat. No. | Entitled |
|---|---|
| 4,918,917 | Liquid Cooled Exhaust Flange |
| 5,196,655 | Muffler for Marine Engines |
| 5,228,876 | Marine Exhaust System Component Comprising a Heat Resistant Conduit |
| 5,262,600 | In-line Insertion Muffler for Marine Engines |
| 5,444,196 | In-line Insertion Muffler for Marine Engines |
| 5,504,280 | Muffler for Marine Engines |
| 5,616,893 | Reverse Entry Muffler With Surge Suppression Feature |
| 5,625,173 | Single Baffle Linear Muffler for Marine Engines |
| 5,718,462 | Muffler Tube Coupling With Reinforcing Inserts |
| 5,740,670 | Water Jacketed Exhaust Pipe for Marine Exhaust Systems. |
| 6,564,901 | Muffler for Marine Engine |
| 7,581,620 | Marine Muffler with Angularly Disposed Internal Baffle |
| 7,905,322 | Marine Muffler with Angularly Disposed Internal Baffle |

-continued

| U.S. Pat. No. | Entitled |
|---|---|
| 7,942,238 | Marine Muffler with Angularly Disposed Internal Baffle |
| 8,246,403 | Marine Water Drop Muffler |
| 8,651,907 | Water Jacketed Marine Exhaust Components Having Multiple Stream Spray Ring Configurations |

In U.S. Pat. No. 5,262,600, the first named inventor herein disclosed an in-line insertion muffler for marine engines employing a first housing encompassing a second housing which is partitioned by an angularly disposed inner planar baffle that has proven extremely effective in reducing engine noise. In U.S. Pat. No. 5,444,196, the first named inventor herein disclosed an improved version of the in-line muffler having a corrugated sleeve disposed between in the first and second housings. In U.S. Pat. No. 5,625,173, the first named inventor herein disclosed a single baffle linear muffler with an angularly disposed baffle that may be planer, convex, or concave. In U.S. Pat. No. 7,581,620, the first named inventor herein disclosed a marine muffler comprising an elongate cylindrical housing having an inlet and an outlet, and an internal volume partitioned by an angularly disposed internal baffle into a lower chamber in communication with the inlet and an upper chamber in communication with the outlet. A centrally disposed duct passes through the baffle to allow exhaust gas and exhaust cooling water to flow from the lower inlet chamber to upper outlet chamber.

The various linear mufflers made in accordance with the above-referenced patents have achieved tremendous success and widespread acceptance within the marine industry. Such muffler systems have been successfully installed on a wide variety of marine vessels having engines in excess of 1,000 horsepower. Due to the myriad engine packages and exhaust configurations, there exists a need for advancements in marine mufflers that allow for structural adjustments to the muffler to optimize sound suppression and minimize backpressure for specific engine makes and models.

BRIEF SUMMARY OF THE INVENTION

The present invention overcomes limitations present in the art by providing an improved muffler for marine engines having an internal tunable sound suppression structure that is easily adaptable to different configurations thereby allowing for structural adjustments to the muffler to optimize sound suppression and minimize backpressure for particular engine and exhaust conditions. A marine muffler in accordance with the present invention comprises a housing defining an interior volume and including an exhaust inlet and outlet, and an inclined baffle partitioning the interior volume into a lower chamber in communication with the exhaust inlet and an upper chamber in communication with the exhaust outlet. Both the inlet and outlet are preferably formed by generally tubular/cylindrical structures. The outlet may have a reduced diameter as compared to the inlet such that the exhaust gas accelerates through the muffler. The housing preferably defines a generally rectangular cross-section that includes generally planar opposing side walls. Generally vertically disposed exhaust ducts, attached to each side wall, penetrate the baffle thereby placing the upper and lower chambers in fluid communication. Each exhaust duct preferably includes a corrugated partition that divides the exhaust duct into a plurality of non-circular conduits. Each exhaust duct is preferably positioned such that a plurality of conduit inlets are positioned below the baffle in proximity to the bottom of the housing, with a plurality of conduit outlets positioned above the baffle in proximity to the top of the housing. A significant aspect of the present invention involves the ability to tune muffler performance by selectively closing or capping the top portions of one or more conduits thereby modifying exhaust flow dynamics through the muffler resulting corresponding changes in sound suppression and backpressure. A further significant aspect of the present invention involves adapting the caps with relatively small apertures which has proven effective in reducing noise and backpressure. By selectively capping one or more conduits in this manner the muffler can be tuned for maximum performance and silencing.

Accordingly, it is an object of the present invention to provide an improved marine muffler.

Still another object of the present invention is to provide such a marine muffler wherein the baffle partitions the muffler into a lower inlet chamber and an upper outlet chamber.

Yet another object of the present invention is to provide such a muffler wherein the baffle is adapted with tunable exhaust ducts in communication with said inlet and outlet chambers.

Still another object of the present invention is to provide such a muffler wherein the duct is partitioned into a plurality of sub-passages, at least some of which are capped such that the muffler may be tuned for a particular engine/exhaust configuration.

In accordance with these and other objects, which will become apparent hereinafter, the instant invention will now be described with particular reference to the accompanying drawings.

DETAILED DESCRIPTION OF THE INVENTION

Figure 1:
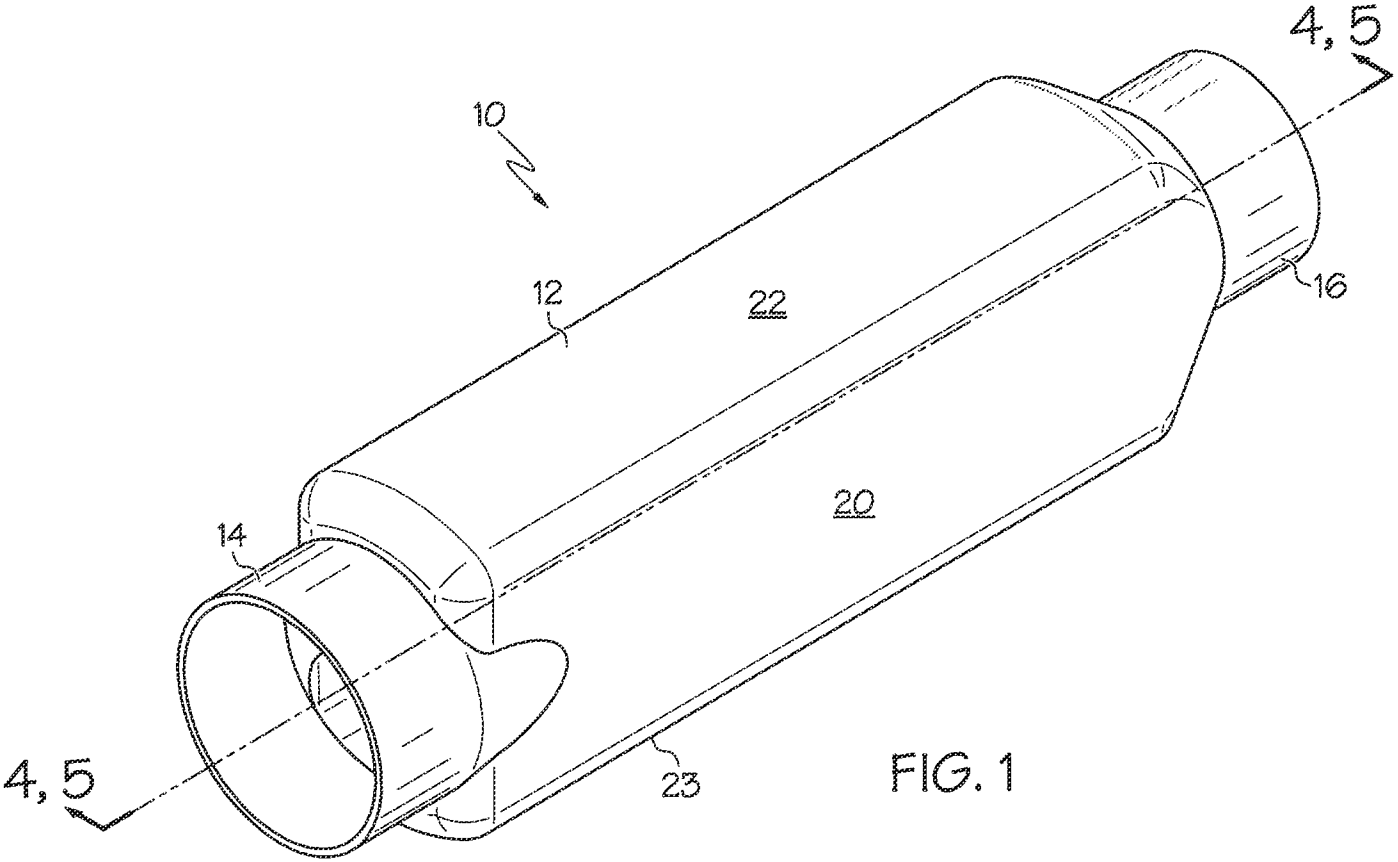
FIG. 1 is an inlet end perspective view of a marine engine muffler in accordance with the present invention.
Figure 2:
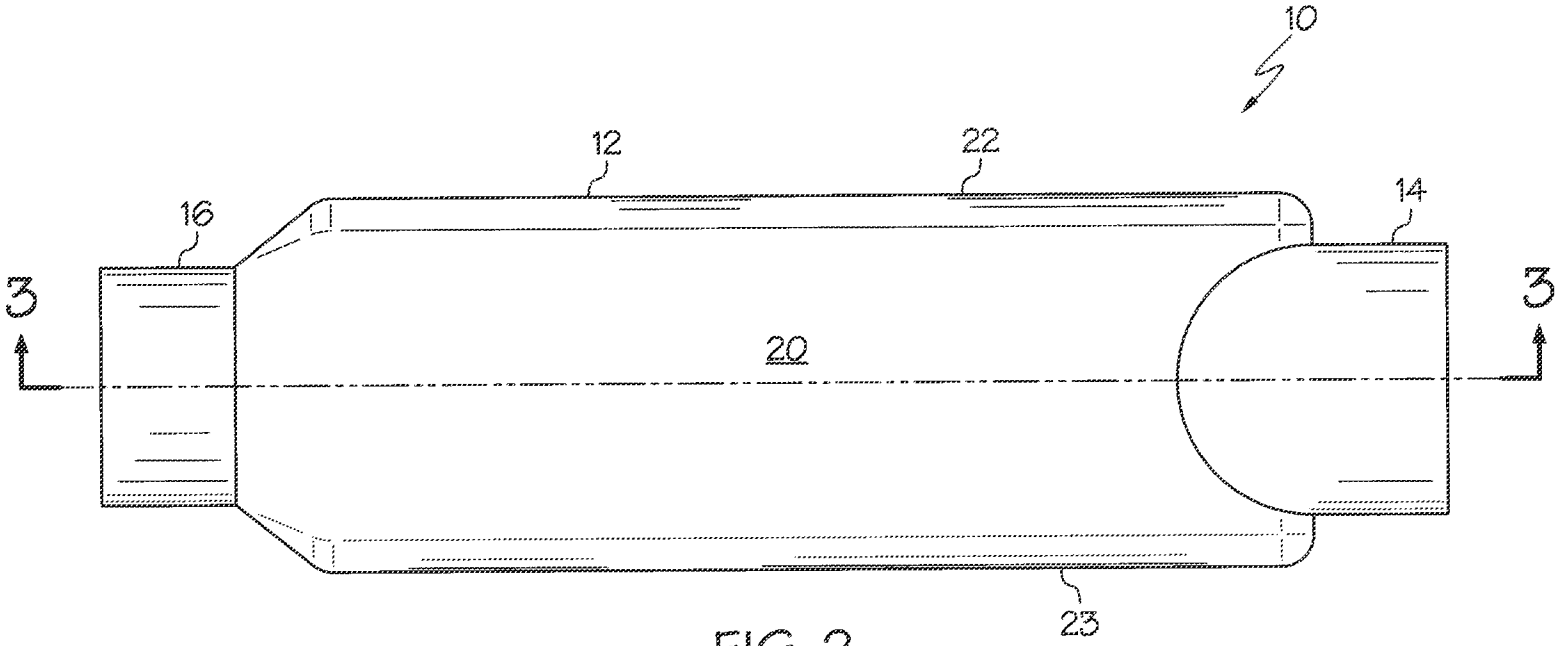
FIG. 2 is a side view thereof.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawings, FIGS. 1-5 depict a preferred embodiment of a muffler, generally referenced as 10, in accordance with the present invention. Muffler 10 is primarily characterized as having a generally hollow muffler housing 12 formed about a longitudinal axis with opposing ends forming a generally cylindrical inlet 14 and a generally cylindrical outlet 16. Inlet 14 is preferably larger in diameter (e.g. larger cross-sectional area) than outlet 16 so as to cause exhaust gas flowing therethrough to accelerate such that exhaust gas exits outlet 16 with a greater velocity than the velocity if measured at inlet 14. In a preferred embodiment, housing 12 is fabricated from a composite material such as temperature resistant fiberglass, however, any suitable material is considered within the scope of the present invention. Housing 12 preferably includes generally planar opposing side walls, each referenced as 20, a top 22 and a bottom 23. Housing 12 preferably comprises a generally rectangular cross-section. In an alternate embodiment, top 22 and bottom 23 may define arcuate interior surfaces which may be either convex or concave when viewed from the interior of housing 12. Providing the housing with arcuate top and bottom surfaces has been found to provide improved strength/stiffening and thus reduce vibration of the top and bottom surfaces thereby reducing housing vibration generated noise. These arcuate surfaces may be formed by curved inserts affixed to the top and bottom of the housing interior or may be integrally formed as the top and bottom surfaces. Housing 12 is preferably elongate. More particularly, the length of the housing (as measured from inlet to outlet) is larger than the housing width (as measured from side-to-side) and housing height (as measured from top to bottom). The present invention is suitable for use with housings having various shapes and thus should not be construed as being limited to the housing configuration disclosed above.

Figure 3:
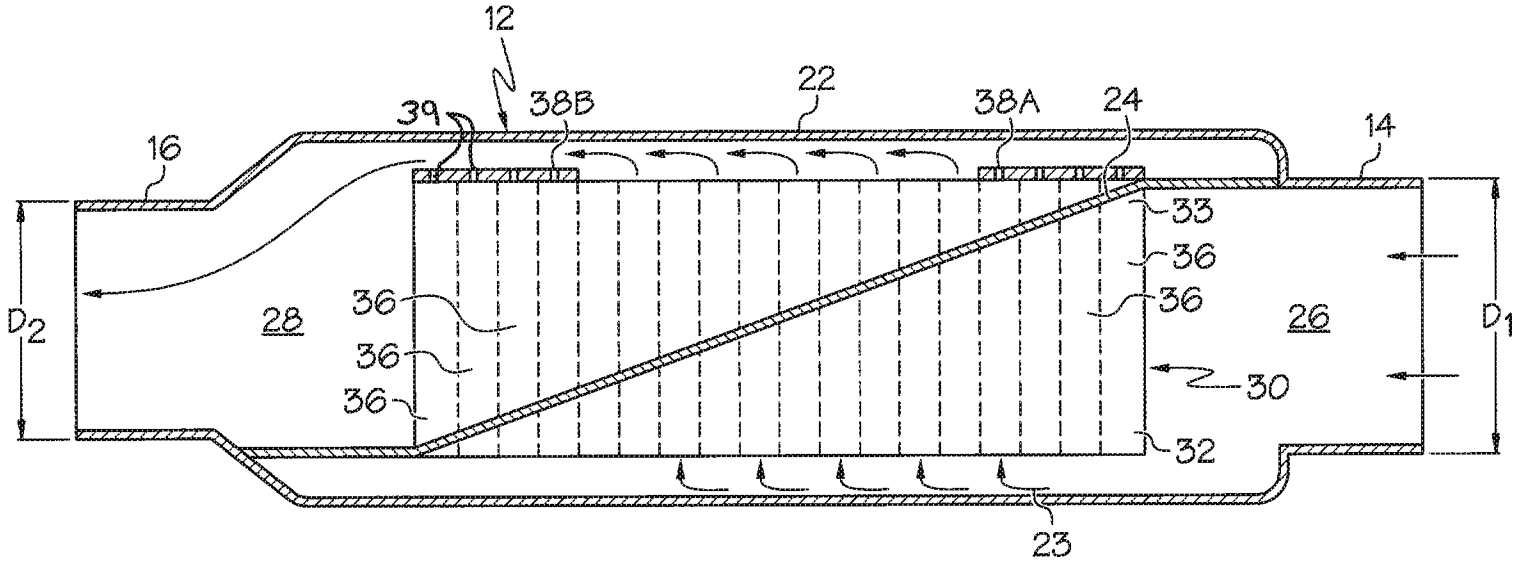
FIG. 3 is a sectional side view thereof taken along line 3-3 of FIG. 2.

As best depicted in FIG. 3, muffler housing 12 defines an internal volume and includes an angularly disposed/inclined baffle 24, having a peripheral edge in sealing engagement with the inner surface of housing 12 so as to divide the internal volume into a lower/inlet chamber 26 (e.g. the volume disposed below the baffle) and an upper/outlet chamber 28 (e.g. the volume disposed above the baffle). In a preferred embodiment baffle 24 is generally planar, however, any suitable shape, such as concave or convex (about either a longitudinal axis or alternatively a transverse axis when viewed from above), is contemplated and considered within the scope of the present invention. Baffle 20 is angularly disposed or inclined as illustrated in FIG. 3. As should be apparent, the angle of inclination will vary depending on the dimensions of the muffler housing, however, in the preferred embodiment the angle of inclination is dictated by the length and height of the housing as the baffle preferably divides the housing interior into roughly equal upper and lower chambers. More particularly, baffle 20 extends angularly downward from in proximity to the top of housing 12 proximal muffler inlet 14 to in proximity of the bottom of housing 12 proximal muffler outlet 16. As should be apparent, the exact terminus of baffle 20 is not considered particularly important so long as the interior of housing 12 is divided into a lower chamber at the inlet side and an upper chamber at the outlet side. While baffle 20 is preferably disposed so as to define upper and lower chambers of generally equal volumes, the baffle may be configured to form chambers of different sizes and/or dimensions in accordance with the present invention. Accordingly, exhaust entering the muffler enters the inlet chamber 26, which chamber is defined by the lower surface of baffle 24 and the inner surfaces of opposing side walls 20 and bottom 23.

Figure 4:
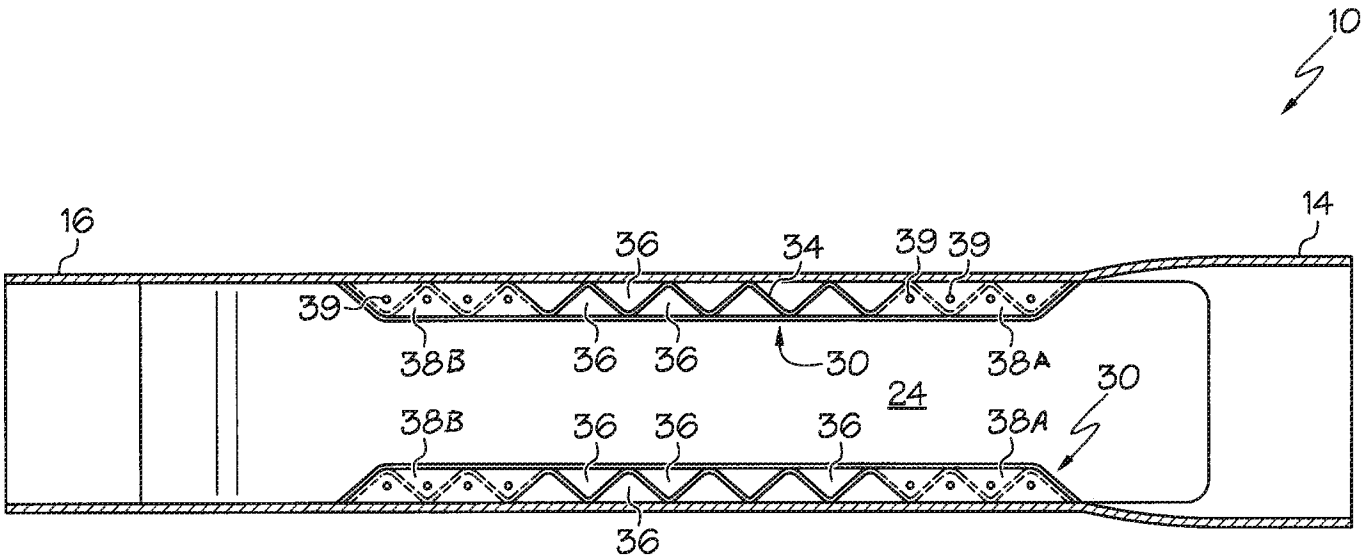
FIG. 4 is a sectional top view taken along line 4-4 of FIG. 1, to reveal internal structure.
Figure 5:
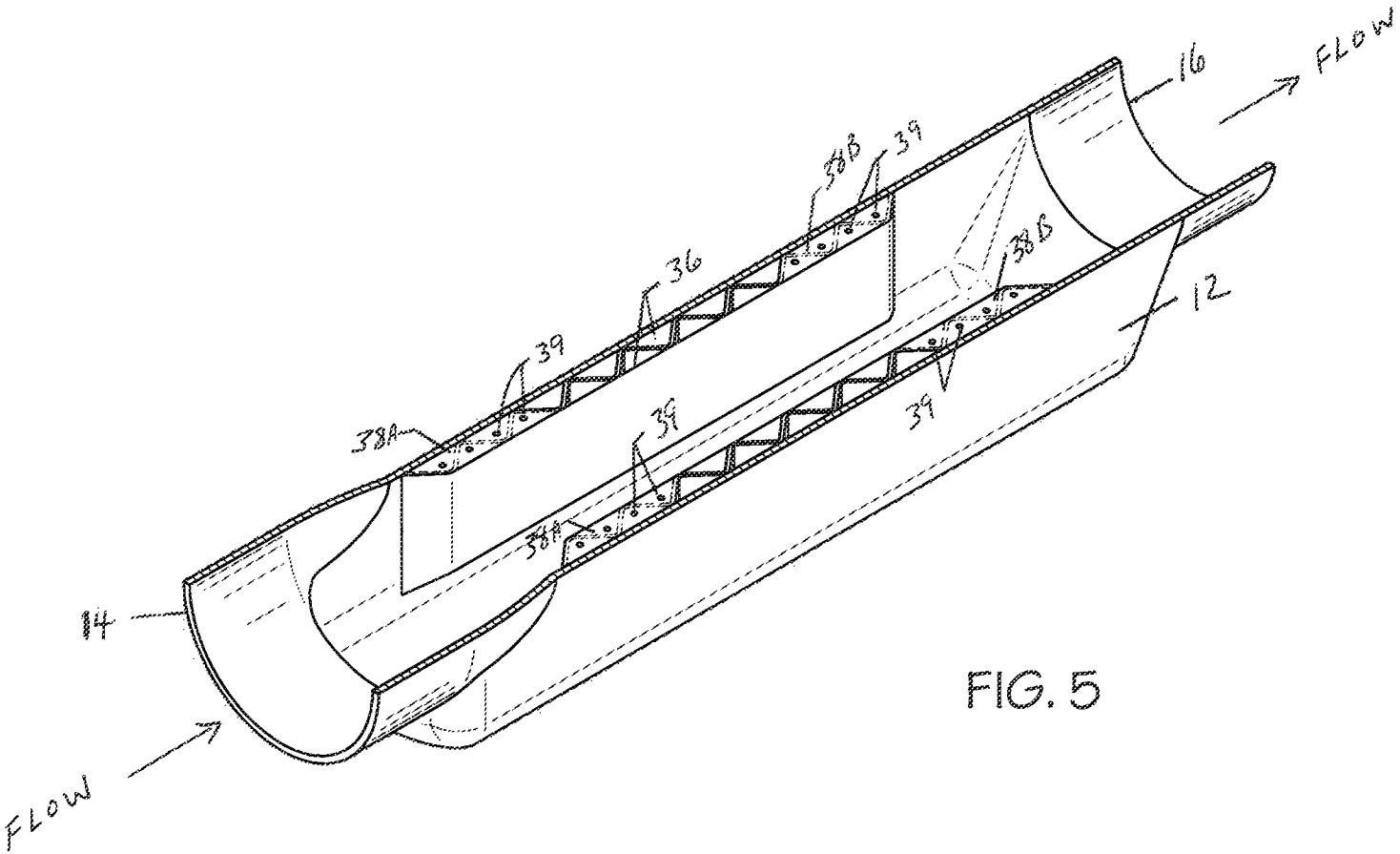
FIG. 5 is perspective sectional view thereof.

An exhaust duct, generally referenced as 30, has edges attached in sealing engagement to the inner surface of each opposing side wall 20 and extends through baffle 24. Each exhaust duct 30 includes an open bottom end 32, and an open top end 33 disposed above the bottom end 32. Exhaust ducts 30 are generally vertically disposed and penetrate baffle 24 thereby placing the upper and lower chambers, 26 and 28, in fluid communication. Each exhaust duct 30 preferably defines a generally rectangular cross section, and may terminate in laterally outwardly flared ends 31, as best seen in FIG. 4. Each exhaust duct 30 preferably includes a corrugated partition 34 that divides the exhaust duct into a plurality of non-circular exhaust conduits, referenced as 36. Exhaust duct 30 and corrugated partition 34 further function to stiffen the generally planar housing side walls 20, thereby reducing the tendency of (non-reinforced) side walls to vibrate in response to exhaust gas pulsation. This reduction in housing side wall vibration results in a quieter muffler by reducing the transmission of vibration related noise external to housing 12. Exhaust ducts 30 are preferably sized and positioned such that the bottom ends thereof place the conduit inlets in proximity to the bottom 23 of the housing 12, and the top ends thereof place the conduit outlets in proximity to the top 22 of housing 12.

As best seen in FIGS. 3 and 4, a significant aspect of the present invention involves selectively closing-off or capping the top portions of one or more conduits, by affixation of one or more cap(s) referenced as 38A and 38B. Caps 38A are attached in sealing engagement with the top 33 of duct 30 so as to seal off one or more exhaust conduits 36 thereby modifying exhaust flow dynamics through the muffler resulting corresponding changes in sound suppression and backpressure. By selecting the number and location of conduits 36 to cap, the muffler may be tuned to maximize sound suppression and backpressure. By way of example, FIG. 3 illustrates capping four (4) conduits at each end of duct 30. As should be apparent, the number and location of capped conduits may vary depending upon the exhaust flow characteristics and dynamics for a given application. Thus, any suitable capping arrangement, including the non-use of caps 38A and 38B, is considered within the scope of the present invention. In a preferred embodiment cap 38A is affixed in sealing engagement with the top portion 33 of duct 30 on the inlet side of muffler 10 so as to substantially seal off one or more exhaust conduits 36 disposed toward at the inlet end of duct 30. Similarly cap 38B is affixed in sealing engagement with the with the top portion 33 of duct 30 on the outlet side of muffler 10 so as to substantially seal off one or more exhaust conduits 36 disposed toward at the outlet end of duct 30. Further, the preferred positioning of caps 38A and 38B is as shown in FIG. 3, namely cap 38A fixed in covering relation with one or more exhaust conduits 36 on the inlet end of duct 30, and cap 38B fixed in covering relation with one or more exhaust conduits 36 on the outlet end of duct 30, with the remaining exhaust conduits therebetween left open (e.g un-capped). Accordingly, muffler 10 may be adapted with a single cover, e.g. 38A, while not employing the second cover 38B. The use of both caps 38A and 38B is preferred, but considered optional.

A further significant aspect of the present invention involves the ability to further tune the muffler by forming relatively small apertures 39 in one or more of the caps 38A and/or 38B. Apertures 39 allow for limited exhaust flow through the otherwise capped conduits and thereby further allow the muffler to be tuned for a specific application. By varying the number, location, and radius of apertures 39 the performance of the muffler may be further tuned and refined. Apertures 39 are preferably ⅛" in diameter, however, the size may be adjusted to any suitable diameter within the scope of the present invention.

As best illustrated in FIG. 3, exhaust gas and exhaust cooling water enter the inlet chamber 26 of muffler 10 via inlet 14. Under certain conditions wherein the engine is operating at relatively low RPM's, it is expected that exhaust gas cooling water will begin to pool on the housing floor or bottom 23 within inlet chamber 26. As the water level rises, it will eventually begin to choke the flow paths to the exhaust conduit inlets at the lower portion 32 of duct 30. As a result, the exhaust gas velocity will naturally increase thereby causing entrainment of the water with the exhaust gas and as the exhaust gas flows upward through the un-capped, generally centrally disposed conduits 36. The exhaust gas and water exit duct 30 through the top portion 33 of duct 30 via the exhaust conduits 36 into outlet chamber 28 whereafter the exhaust gas and entrained cooling water are allowed to exit via muffler outlet 16. A muffler in accordance with the present invention may be fabricated from composite material, such as heat resistant fiberglass, or any other suitable material.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A marine muffler comprising:

a generally hollow muffler housing defining an interior volume;

said housing including a first end forming an exhaust inlet and an opposing second end forming an exhaust outlet;

a baffle disposed within said housing, said baffle having a peripheral edge in sealing engagement with said housing so as to divide the internal volume into a lower inlet chamber and an upper outlet chamber;

an exhaust duct extending through said baffle and terminating in an open bottom end in fluid communication with said inlet chamber, and an open top end in fluid communication with said outlet chamber; and at least one cap affixed in covering relation with at least a portion of the top end of said exhaust duct.

2. The marine muffler according to claim 1, wherein said exhaust inlet has a larger cross-sectional area than said exhaust outlet.

3. The marine muffler according to claim 1, further including a partition disposed within said exhaust duct, said partition dividing said exhaust duct into a plurality of exhaust conduits.

4. The marine muffler according to claim 3, wherein said plurality of exhaust conduits include non-circular conduits.

5. The marine muffler according to claim 1, wherein said at least one cap defines an aperture.

6. The marine muffler according to claim 1, wherein said baffle is planar.

7. The marine muffler according to claim 1, wherein said baffle is convex.

8. The marine muffler according to claim 1, wherein said baffle is concave.

9. The marine muffler according to claim 1, wherein said housing top and bottom each include arcuate surfaces.

* * * * *